United States Patent [19]

Nava

[11] Patent Number: 4,703,946

[45] Date of Patent: Nov. 3, 1987

[54] SKI ATTACHMENT DEVICE

[75] Inventor: Pier L. Nava, Bergamo, Italy

[73] Assignee: Nava & C. S.p.A., Como, Italy

[21] Appl. No.: 811,537

[22] Filed: Dec. 20, 1985

[30] Foreign Application Priority Data

Feb. 11, 1985 [IT] Italy ..... 19462 A/85

[51] Int. Cl.[4] ..... A63C 9/08

[52] U.S. Cl. ..... 280/627; 280/11.36

[58] Field of Search ..... 280/613, 618, 627, 626, 280/11.36

[56] References Cited

U.S. PATENT DOCUMENTS

| | | | |
|---|---|---|---|
| 3,785,668 | 1/1974 | Marker | 280/613 |
| 3,838,866 | 10/1974 | Alessio et al. | 280/613 X |
| 3,931,980 | 1/1976 | Marker | 280/613 |
| 4,098,522 | 7/1978 | Beyl | 280/618 |
| 4,168,085 | 9/1979 | Faulin | 280/618 |
| 4,264,088 | 4/1981 | Replogle | 280/618 X |
| 4,284,292 | 8/1981 | Faulin | 280/613 X |
| 4,353,574 | 10/1982 | Faulin | 280/613 |

*Primary Examiner*—David M. Mitchell
*Assistant Examiner*—Michael Mar
*Attorney, Agent, or Firm*—Ladas & Parry

[57] ABSTRACT

A ski attachment device having a safty feature that allows disengagement of the boot from the ski in the case of lateral or front falls of the skier. The device comprises a rear unit adapted to be attached to the ski and including a spring for applying a longitudinal forward thrust to the rear of the boot. A front unit includes a plate having a "V" shaped seat to be engaged by a grooved rotatable roller housed in a cavity in a sole of the boot.

4 Claims, 6 Drawing Figures

SKI ATTACHMENT DEVICE

DESCRIPTION

This invention relates to an attachment device for skis. Safety attachment A is disclosed that allows disengagement of the boot from the ski when certain stress values are exceeded in case of lateral or front falls of the skier.

In the known attachment devices, the skier's boots are secured to the known skis by sprung devices fitted on the skis themselves. These sprung devices exert their action both on the skier's boots and, by suitable intermediate controls, on the rear part of the skier's calf and contemplate means apt to secure the boot on the ski in normal use, while the boot can be detached from the ski in case of accident.

The purpose of this invention is to improve the detachment safety of the boot from the ski, both when the ski is loaded or unloaded, reducing, in particular to adjustable uniform values the rotating moment necessary to effect said disengagement with a minimum torsional effort applied to the shin bone of the skier. The ski attachment device in which the sprung means secured to the ski are also secured both to the calf and rear of the heel of the skier's boots and in which a horizontal thrust is applied to the boot by rear sprung means apt to urge the boot against a front stop plate secured to the ski, is characterized in that said front stop is engaged by a grooved rotatable element, secured to the boot to maintain its sole uplifted from the ski. A longitudinally grooved base is provided around the mid position between said rotatable element and the application point of the thrust of the rear sprung means. Said groved base is secured to the sole and within his longitudinal groove is inserted a pin integral with the ski and projecting from a plate rotatable coaxially with said pin. The bottom lateral surface of the base rests on said plate, and the groove of the base constitutes, together with the pin, a longitudinal slidable guideway to keep the boot centered with ski and acts as a fulcrum apt to normalize the disengagement of the boot from the ski in a torsional direction before the torque becomes dangerous for the safety of the skier's legs.

The invention will now be described, by way of example, in conjunction with the attached drawings in which.

Figure 1:
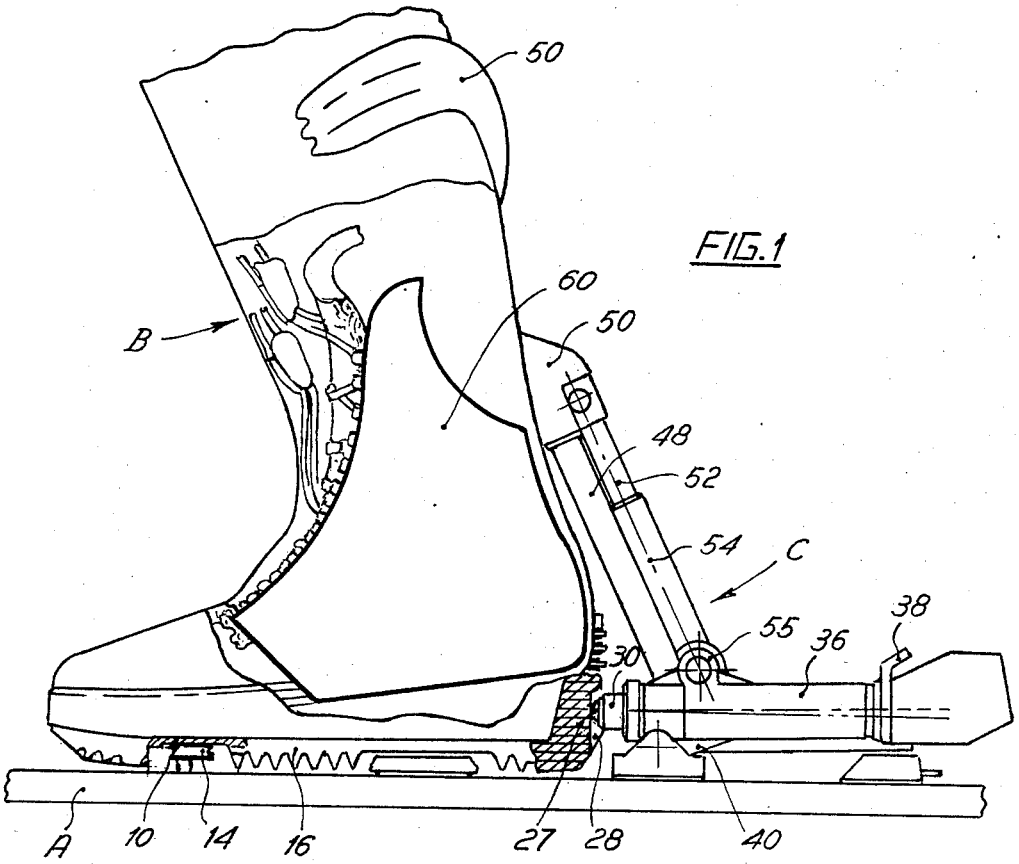
FIG. 1 is a side elevation view showing parts in cross section of the attachment according to the invention.
Figure 2:
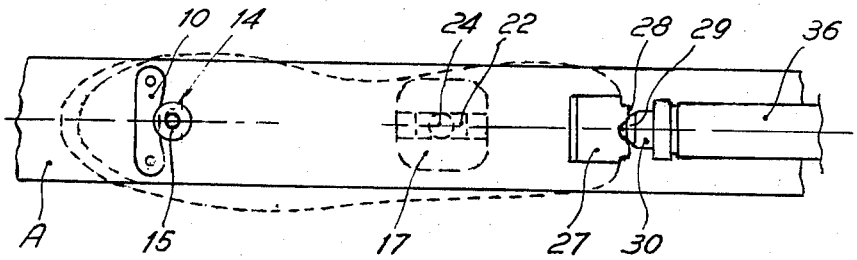
FIG. 2 is a top view of the ski according to FIG. 1, but without the boot.
Figure 3:
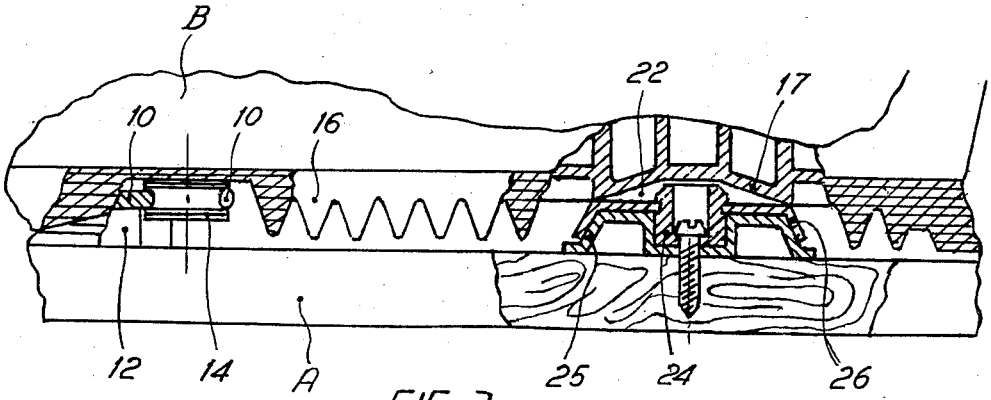

FIG. 3, similar to FIG. 1 shows the conjunction between boot and ski on a larger scale.

Figure 4:
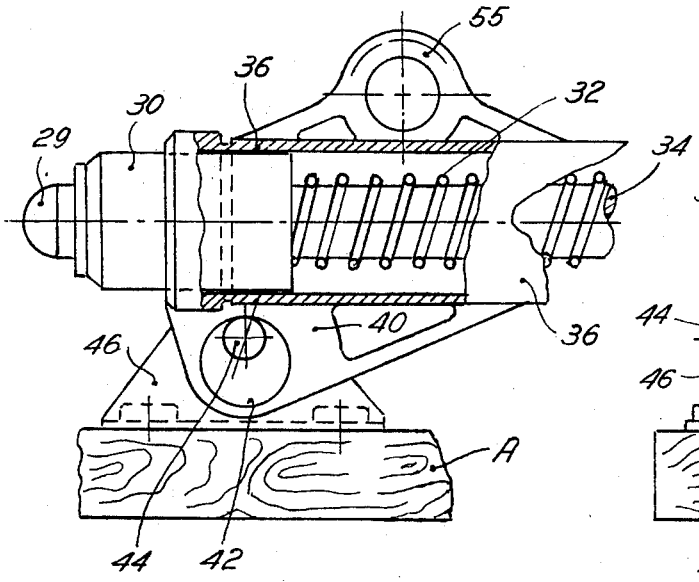
Figure 5:
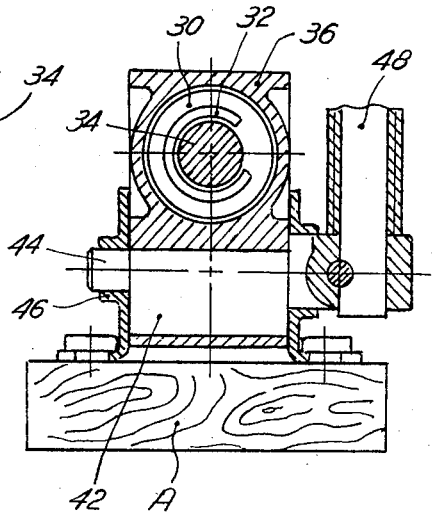

FIGS. 4 and 5 are axial and transversal sections of the sprung assembly of the ski.

Figure 6:
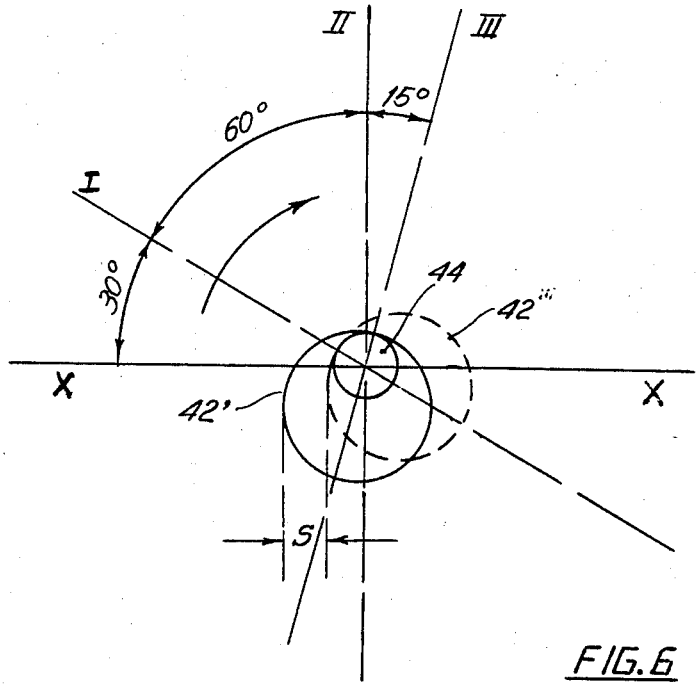

FIG. 6 is a sketch showing the kinematic connection of the sprung devices of FIG. 4.

With reference to the drawings, in particular to FIG. 1, the ski is identified by letter A and B is the skier's boot retained on said ski by device C.

The device is comprised of a front stop plate 10, provided with a "V" shaped seat, the plate 10 being secured to ski A by a spacer 12 apt to maintain the sole of boot B conveniently spaced from the ski.

A grooved roller 14 engages with the profiled edge of plate 10; pin 15 of the roller is suitably secured and housed in the bottom of sole 16 of boot B so as to be contained in a cavity of said sole without projecting from the surface of the sole itself. The substantially middle part of sole 16 of boot B, corresponding with the arch of the skier's foot, is provided with a base 17 integral with the sole.

The center part of base 17 has a groove 22, substantially parallel to the axis of the ski and which houses a pin 24 apt to slide along the walls of groove 22, said pin 24 forming an integral part of ski A through a shaped element 25. Groove 22, allows therefore a suitable mobility to boot B on the longitudinal axis of the ski during use. A truncated cone shaped associated element 26 is rotatably movable on element 25, the bottom of base 17 being supported on said element 26.

Again in relation to the connection of boot B to ski A, the rear part of the boot adjacent to the lower part of the heel, is provided with a block 27 having a suitably shaped seat 28 apt to engage ball head 29 fitted on the end of a slider 30.

A spring 32 (see FIG. 4)is inserted on a rod 34 integral with said slider 30; the spring is retained on the perforated bottom of a bushing 36 in which the rod 34 operates.

The action of spring 32 can be neutralized by means of a lever 38 which is pivoted on the threaded free end of the rod 34 and cooperates with the end of said bushing 36 to maintain slider 30 in a retracted position, to disengage it from seat 28 of block 27. When lever 38 is actuated, the slider 30 is disengaged from the seat of block 27 to free the boot B from ski A; on the other hand, when said lever 38 is free, the spring 32 acts on slider 30 and maintains roller 14 of boot B engaged with the V shaped profile of plate 10 of ski A.

Bushing 36 is provided, on one of its ends, with a tab 40 engaging with an eccentric pin 42, the ends 44 of which engage inturn with the holes of a support 46 secured to ski A.

A rod 48 is attached to one of the ends 44 of eccentric pin 42; said rod 48 extends upwardly and terminates with an arched element 50 (FIG. 1) apt to engage with the skier's calf. As a result of the action of spring 32 on eccentric 42–44, it ensures that during use of the ski the arched element 50 is maintained in engagement with the skier's calf and follows the movements of the leg during use of the ski.

The upper end of rod 48 (see FIG. 1) is secured, by a universal joint at a point close to the connection of the arched element 50, to the movable part 52 of a pneumatic spring 54 the other end of which is joined by a hinge 55 to bushing 36. Therefore the movements of the skier's legs are favoured and followed by the springing action of pneumatic spring 52–54 and by the action of spring 32 on the boot.

Moreover, the action of spring 32 on boot B is also affected by eccentric 42 which is rotatably joined with bushing 36. The behaviour of device C during use is illustrated in FIG. 6 which shows schematically the extreme positions of eccentric 42–44 of FIG. 4 in different way of use.

In the rest position the rod 48, under the action of pneumatic spring (52–54), is urged against ski A showed in the figure by line X—X.

More specifically when rod 48 is in its rest or idle position (i.e. when the boot is disengaged form the ski) it can be stated that the rod assumes the position identified by horizontal line X—X. In the initial working position I at an angle of approximately 30° from the preceeding position the eccentric 42, which rotates around pin 44, assumes the position shown in the figure identified by continuous line 42'. From this position onward, the rod can reach position II by performing an angular movement of approximately 60°, corresponding to the excursion required in normal sking, followed by a further complementary maximum shift of 15° up to line III, where the eccentric sets itself in position 42''' designated by the dotted line.

In brief, rod 48 can perform a shifting movement starting from initial working position I up to position III, a maximum angular shift of 75°, while eccentric 42 performs a corresponding horizontal shift "S" equal to approximately six millimeters computed on the actual dimensions of the device according to the invention, thereby varying in said measure the compression of spring 32 when the ski is in use.

Referring again to FIG. 1, in order to control the mobility of the foot, a shaped reinforcement lamina 60 is inserted in the boot at the height of skier's ankle. Said shaped lamina 60 is made of plastic material of adequate thickness which can vary between 0.5 and 2.5 millimeters and which is shaped so as to adapt itself conveniently to the part of the skier's foot.

In addition to providing the best possible protection against impact, the in question in question makes it possible to control the thrusts of spring rod 48 and thereby eliminate a part of the muscular strain. Shaped lamina 60 may be provided with perforations or apertures for ventilation and its ends may be either in the front or rear, depending on use requirements.

It clearly emerges from what hereinabove described and illustrated that the scope proposed by the invention has been achieved. In fact, in the devices known heretofore, disengagement of the boot from the ski, especially during excessive torsional stresses which are the cause of most accidents to the tibia of the skier, still remains impredictably influenced by the friction conditions between the sole and the ski. In the device according to this invention, the front part of the sole remains lifted from the ski the boot being engaged with the throat of grooved roller 14 against V shaped plate 10 and set at a suitable height to maintain the surface of the sole lifted from that of the ski. Said position can be maintained becausethe boot B is freely urged against plate 10 by the thrust exerted by the rear sprung means which discharge the thrust on roller 14 without being opposed by any impediment. In fact the sole is free to float in the longitudinal direction with respect to the ski, since pin 24 can run in said direction, being contained only transversally by the walls of groove 22 of plaque 17.

Also the heel on the boot rests slightly on the ski, being supported by rotary element 26 on which the lower face of base 17 rests.

In this way the detachment of the boot by torsion is ensured, in that the boot itself, pivoted on pin 24, can be disengaged beyond an expected stress limit both from plate 10 and from slider 30 said limit being comprised and adjustable within the limits allowed by the safety test regulations.

I claim:

1. A ski binding assembly for releasably securing a boot to a ski comprising:

a rear binding unit having a housing adapted to be attached to the ski, a spring biased piston guided for longitudinal movement within said housing, said piston adapted to be received within a rear portion of said boot for imparting a forward thrust thereto, an eccentric pin for pivotally mounting said housing to the ski, a rigid rod having a lower end secured to said eccentric pin and an upper end having an arched element secured thereto for engaging the skier's calf, and a pneumatic spring member having an upper end connected to said arched element and a lower end pivotally connected to an upper portion of said housing a front binding unit adapted to be attached to the ski at a location below the front portion of said boot, said front binding unit including a plate having a V-shaped seat portion, a grooved roller rotatably mounted within a recessed sole portion of said boot, said V-shaped seat adapted to be engaged by said grooved roller for maintaining the front portion of said boot sole at a location spaced above the top surface of the ski; and guide means at a location spaced below the arch portion of the skier's foot for maintaining said boot centered along the central axis of the ski, said guide means including a longitudinal shaped groove formed within a cavity portion of said boot sole which interacts with pin means and rotatable means secured to the ski for permitting relatively free longitudinal and rotary movement of said boot relative to the ski.

2. A ski binding assembly, as in claim 1 wherein the V-shaped seat is provided in its middle part with an arched notch housing the groove of the roller for engaging with the roller.

3. A ski binding assembly, as in claim 1 further comprising a relatively rigid sheath for engaging with a skier's ankle and foot, and housed in the ski boot.

4. A ski binding assembly, as in claim 3 wherein the sheath, made of relatively rigid material, is open in front to facilitate wearing.

* * * * *